US006716310B2

(12) United States Patent
Sun et al.

(10) Patent No.: US 6,716,310 B2
(45) Date of Patent: Apr. 6, 2004

(54) PROCESS FOR MANUFACTURING A CELLULOSIC PAPER PRODUCT EXHIBITING REDUCED MALODOR

(75) Inventors: Tong Sun, Neenah, WI (US); James J. Tanner, Winneconne, WI (US); Tameka Spence, Lawrenceville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/038,877

(22) Filed: Dec. 31, 2001

(65) Prior Publication Data

US 2003/0131961 A1 Jul. 17, 2003

(51) Int. Cl.[7] ..... D21H 3/00

(52) U.S. Cl. ..... 162/158; 162/159; 162/90; 162/51; 162/181.2

(58) Field of Search ..... 162/158, 159, 162/90, 51, 181.2, 128

(56) References Cited

U.S. PATENT DOCUMENTS

| | | | | |
|---|---|---|---|---|
| 310,753 | A | 1/1885 | Walker | |
| 1,381,440 | A | 6/1921 | Taylor | |
| 1,839,136 | A | * 12/1931 | Vivas | |
| 2,644,750 | A | * 7/1953 | Frisch et al. | 92/21 |
| 3,017,316 | A | 1/1962 | Rapson | |
| 3,068,141 | A | 12/1962 | MacClaren | |
| 3,305,433 | A | 2/1967 | Partlow | |
| 3,438,847 | A | * 4/1969 | Chase | 161/166 |
| 3,544,364 | A | 12/1970 | Rudner et al. | |
| 3,594,270 | A | 7/1971 | Schattner | |
| 3,620,909 | A | 11/1971 | Gleason | |
| 4,292,188 | A | * 9/1981 | Barone et al. | 252/62 |
| 4,352,719 | A | * 10/1982 | Herr | 162/128 |
| 4,372,309 | A | 2/1983 | Fowler | |
| 4,372,814 | A | 2/1983 | Johnstone et al. | |
| 4,401,810 | A | 8/1983 | Tang et al. | |
| 4,487,657 | A | 12/1984 | Gomez | |
| 4,820,307 | A | 4/1989 | Welch et al. | |
| 5,035,772 | A | 7/1991 | Agnemo et al. | |
| 5,122,407 | A | 6/1992 | Yeo et al. | |
| 5,130,352 | A | 7/1992 | Chow | |
| 5,199,953 | A | 4/1993 | Fung et al. | |
| 5,352,242 | A | 10/1994 | Lämmermann et al. | |
| 5,364,380 | A | 11/1994 | Tanzer et al. | |
| 5,620,510 | A | 4/1997 | Mentzer et al. | |
| 5,674,358 | A | 10/1997 | Espy | |
| 6,149,767 | A | 11/2000 | Hermans et al. | |
| 6,488,812 | B2 | * 12/2002 | Shannon et al. | 162/164.6 |

FOREIGN PATENT DOCUMENTS

| | | |
|---|---|---|
| EP | 0 261 316 A1 | 3/1988 |
| WO | WO 99/13022 A1 | 3/1999 |

OTHER PUBLICATIONS

English Abstract of German Patent Publication No. 0261316, pub. date Mar. 30, 1988, printed from esp@cenet database Nov. 26, 2002.

Cullis, C.F., et al., "Combustion of Cigarette Paper Under Conditions Similar to Those During Smoking", *Cellulose & Its Derivatives*, 1985, Chapter 35, Kennedy et al., eds., Ellis Horwood Ltd.

LeVan, S.L., "Chemistry of Fire Retardancy", *The Chemistry of Solid Wood*, 1984, Chapter 14, R. Rowell, editor, Advances in Chemistry Series 207 American Chemical Society.

Shafizadeh, F., "Thermal Degradation of Cellulose", *Cellulose Chemistry and its Applications*, 1985, Chapter 11, Nevell & Zeronian, eds., Ellis Horwood Ltd.

K.Wiik, et al., "Studies on Odour Reduction in TCF Bleached Packaging Paper", *Journal of Pulp and Paper Science*, Sep. 1998, vol. 24, No. 9.

Derwent World Patent Index (WPI) abstract for CA 898689, published 1972.

Derwent World Patent Index (WPI) abstract for EP 261 316, published 1988.

* cited by examiner

*Primary Examiner*—Steven P. Griffin
*Assistant Examiner*—Mark Halpern
(74) *Attorney, Agent, or Firm*—Senniger, Powers, Leavitt & Roedel

(57) ABSTRACT

A process for manufacturing a cellulosic paper product is provided. The process comprises forming an aqueous suspension of papermaking fibers; introducing a borate compound, preferably boric acid, into the aqueous suspension; depositing the aqueous suspension onto a sheet-forming fabric to form a wet web; and dewatering and drying the wet web. The process of the present invention provides cellulosic paper products exhibiting a reduced malodor upon re-wetting.

7 Claims, No Drawings

PROCESS FOR MANUFACTURING A CELLULOSIC PAPER PRODUCT EXHIBITING REDUCED MALODOR

FIELD OF THE INVENTION

The present invention relates, in general, to methods for making cellulosic paper products, and, more particularly, to methods for reducing or eliminating malodor released from a cellulosic base sheet upon re-wetting.

BACKGROUND OF THE INVENTION

Commercial paper products such as hand towels are manufactured from cellulosic base sheets. A cellulosic base sheet is a paper product in its raw form prior to undergoing post-treatment such as calendaring and embossing. In general, cellulosic base sheets are made by preparing an aqueous suspension of papermaking fibers and depositing the suspension onto a sheet-forming fabric to form a wet web, which is then dewatered and dried to produce a base sheet suitable for finishing.

Wet web base sheets are commonly dried by through-air drying, which comprises removing water from a wet web by passing hot air through the web. More specifically, through-air drying typically comprises transferring a partially dewatered wet-laid web from a sheet-forming fabric to a coarse, highly permeable through-drying fabric. The wet web is then retained on the through-drying fabric while heated air is passed through the web until it is dry. One process for through-drying base sheets is the Un-Creped Through Air Dried (UCTAD) process, as described, for example, in U.S. Pat. No. 6,149,767, which is hereby incorporated by reference. In the UCTAD process, a wet base sheet is partially dewatered and through-air dried by passing hot air through the wet sheet as it runs over a through-drying fabric on a drum roll.

Based upon consumer complaints, it was observed that a strong, burnt popcorn odor was often emitted from hand towels when the towels were wetted. Upon investigation, this problem of malodor was found to be present in cellulosic base sheets which had been through-air dried at relatively high air temperatures including, for example, sheets dried by the UCTAD process. It was hypothesized that over-drying or over-heating of the base sheets was leading to the malodor problem upon re-wetting. By operating the through-air drying process at lower temperatures and slightly longer residence times, the malodor problem can be largely eliminated. However, lower operating temperatures and longer residence times adversely affect the overall productivity of the base sheet manufacturing process. Therefore, a need exists for a process which can eliminate malodor in through-dried cellulosic base sheets wherein higher drying temperatures and shorter residence times can be used to increase product throughput and productivity.

SUMMARY OF THE INVENTION

Among the several objects of the present invention, therefore, is the provision of a process for making a cellulosic paper product from a wet-laid web; the provision of such a process wherein the paper products exhibit a reduced malodor upon re-wetting; the provision of such a process wherein the wet-laid web can be through-air dried at higher temperatures and shorter residence times; the provision of such a process wherein productivity and throughput are increased; and the provision of such a process which is relatively inexpensive and easy to implement.

Briefly, therefore, the present invention is directed to a process for manufacturing a cellulosic paper product. The process comprises forming an aqueous suspension of papermaking fibers; depositing the aqueous suspension onto a sheet-forming fabric to form a wet web; and dewatering and drying the wet web. The process is further characterized in that a borate compound is introduced into the aqueous suspension of papermaking fibers, the borate compound having the formula:

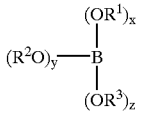

wherein $R^1$, $R^2$ and $R^3$ are independently selected from the group consisting of hydrogen and a saturated or unsaturated, substituted or unsubstituted, branched or straight chain hydrocarbyl moiety having from 1 to about 20 carbon atoms and x, y and z are integers $\geqq 0$ such that $x+y+z=3$.

In one preferred embodiment, the process of the present invention comprises forming an aqueous suspension of papermaking fibers and introducing boric acid into the aqueous suspension. The aqueous suspension is deposited onto a sheet-forming fabric to form a wet web after the introduction of boric acid into the aqueous suspension and the wet web is dried by passing heated air through the wet web.

The present invention is also directed to cellulosic paper products exhibiting a reduced malodor upon re-wetting. The cellulosic paper product is produced by a process comprising forming an aqueous suspension of papermaking fibers; depositing the aqueous suspension onto a sheet-forming fabric to form a wet web; and dewatering and drying the wet web. The process is further characterized in that a borate compound is introduced into the aqueous suspension of papermaking fibers, the borate compound having the formula:

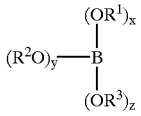

wherein $R^1$, $R^2$ and $R^3$ are independently selected from the group consisting of hydrogen and a saturated or unsaturated, substituted or unsubstituted, branched or straight chain hydrocarbyl moiety having from 1 to about 20 carbon atoms and x, y and z are integers $\geqq 0$ such that $x+y+z=3$.

Other objects and features of the present invention will be in part apparent and in part pointed out hereinafter.

DETAILED DESCRIPTION OF THE PREFERRED EMBODIMENTS

In accordance with the present invention, it has been discovered that a cellulosic base sheet having a reduced malodor upon re-wetting can be produced by introducing a borate compound into an aqueous suspension of the cellulosic papermaking fibers from which the base sheet is formed. The wet-laid base sheets formed from such aqueous suspensions can be dried at higher temperatures and shortened residence times while significantly reducing malodor produced upon re-wetting of the base sheets.

As part of the present invention, possible reaction mechanisms in the base sheet production process which may be contributing to the presence of odorous compounds in cellulosic base sheets have been investigated. Without being held to a particular theory, it is believed that malodor in base sheets dried at high temperatures is caused by acid-catalyzed reactions which form volatile organic compounds or odor precursors during drying. It is believed that these odorous compounds are formed within a cellulosic base sheet during drying and bound within the sheet until the moment that the sheet is re-wetted. The combination of acid in the sheet and the addition of water upon re-wetting cleaves the odorous compounds from the sheet and releases the compounds into the environment. In particular, experience to date suggests that a large number of the odor-causing compounds released from re-wetted base sheets can be characterized as medium chain aliphatic aldehydes (e.g., octanal, nonanal, decanal) and/or furans (e.g., furfural, furfuryl alcohol, hydroxymethyl furfural). Thus, it is believed that the presence of volatile aldehyde compounds and/or furan compounds, either alone or in combination, may be responsible for the base sheet malodor. These odor-causing compounds may be produced during high temperature drying of the wet web by any conventional means including Yankee dryers and through-air dryers, but are particularly problematic in through-dried base sheets, perhaps due to the highly oxidative environment and unique mass transfer phenomena provided by the air stream passing through the web.

Aldehyde Hypothesis

Experience to date with analyzing re-wetted base sheets, as described, for example, in Example 1 below, indicates that a substantial component of the malodor released from through-dried cellulosic base sheets upon re-wetting comprises medium-chain, aliphatic aldehydes having from about 6 to about 10 carbon atoms. Without being bound by a particular theory, it is believed that the aldehydes are formed within the base sheet by the oxidation of fatty acids present in the aqueous suspension of papermaking fibers. For example, during chlorine dioxide bleaching, which is conducted under acidic conditions at a pH of about 3.5, fatty acids present in the aqueous suspension of papermaking fibers are either bound by ester linkages to carbohydrates or oxidized to smaller aliphatic aldehydes. Alternatively, aldehydes may be formed in the base sheet during drying, wherein bound fatty acids within the wet web can be oxidized to aliphatic aldehydes by heating.

As water is driven from the wet web during drying, a portion of the aliphatic aldehydes present in the wet web may react with vicinal diols present in the carbohydrates to form acetal linkages, thus binding the aldehydes to the sheet fibers. This acetal formation between the aliphatic aldehydes and vicinal diols in a wet web base sheet is a reversible reaction, with equilibrium between the free aldehyde and bound acetal depending upon the amount of water present. For example, as water is being driven off, the reaction favors acetal formation. When water is added, and especially in the presence of acid, the acetal will break down to an aldehyde. Therefore, it is believed that when water is added to the dried sheet (i.e., the sheet is re-wetted), an acid-catalyzed reversal of the acetal formation reaction liberates the free aldehyde, thus releasing the aldehyde from the base sheet and into the environment.

Furan-Compound Hypothesis

Analyses of organic extracts from re-wetted base sheets have also indicated the presence of furan components, in particular, furfural, furfuryl alcohol and hydroxymethyl furfural. These furans possess a burnt odor substantially similar to the odor displayed by the re-wetted base sheets. Without being bound by a particular theory, it is believed that acid-catalyzed degradation of carbohydrates present in the base sheet occurs during through-air drying, to generate a furan precursor attached to the carbohydrates. The furan precursor is then liberated and released by another acid-catalyzed reaction when water is added (i.e. the sheet is re-wetted). While the liberation step could theoretically occur during further air-drying, it is believed that a rapid loss of water essentially leaves little or no solvent for subsequent reaction.

Borate Compound Effect

In accordance with the present invention, it has been found that introducing a borate compound into an aqueous suspension of cellulosic papermaking fibers can adequately suppress the formation of aldehydes and/or furans as described above to substantially reduce malodor released upon re-wetting of paper products produced from cellulosic base sheets. For example, without being held to a particular theory, it has been found that introducing a borate compound (e.g., boric acid) into an aqueous suspension of papermaking fibers advantageously results in the formation of a boron ester complex with free acids present within the aqueous suspension. This ester complex formation is believed to substantially eliminate free acids from the aqueous suspension of papermaking fibers that would normally be available to partake in the generation of odorous compounds as previously described.

Therefore, in one embodiment, the process of the present invention generally comprises preparing an aqueous suspension of cellulosic papermaking fibers. Suitable cellulosic fibers for use in the present invention include virgin papermaking fibers and secondary (i.e., recycled) papermaking fibers in all proportions. Such fibers include, without limitation, hardwood and softwood fibers along with non-woody fibers. Non-cellulosic synthetic fibers can also be included as a component of the aqueous suspension. It has been found that a high quality product having a unique balance of properties can be made using predominantly, and more preferably substantially all (i.e., up to 100%) secondary or recycled cellulosic fibers. The aqueous suspension of papermaking fibers may contain various additives conventionally employed by those skilled in the art, including, without limitation, wet strength resins (e.g., KYMENE, Hercules, Inc.), fillers and softeners/debonders.

The process further comprises introducing a borate compound into the aqueous suspension of papermaking fibers. Suitable borate compounds for use in the present invention generally include compounds having the formula

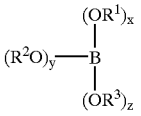

wherein $R^1$, $R^2$ and $R^3$ are independently selected from the group consisting of hydrogen and a saturated or unsaturated, substituted or unsubstituted, branched or straight chain hydrocarbyl moiety having from 1 to about 20 carbon atoms and x, y and z are integers $\geqq 0$ such that $x+y+z=3$. Preferably, $R^1$, $R^2$ and $R^3$ are independently selected from the group consisting of hydrogen and branched or straight chain alkyl having from 1 to about 20 carbon atoms. More preferably, the borate compound is selected from the group consisting of boric acid, trimethyl borate, triethyl borate, tri-n-propyl borate, triisopropyl borate, tri-n-butyl borate, triisobutyl borate, tri-sec-butyl borate and tri-tert-butyl borate. In an especially preferred embodiment, the borate compound comprises boric acid.

Preferably, the borate compound is introduced into the aqueous suspension of papermaking fibers in such an amount that the pH of the aqueous suspension is from about 5 to about 6 after the introduction of the borate compound. More preferably, the borate compound is introduced into the aqueous suspension of papermaking fibers in an amount sufficient to provide an aqueous suspension having a pH of about 5.5 after the introduction of the borate compound. Generally, the borate compound is introduced into the aqueous suspension of papermaking fibers in an amount from about 5% to about 20% by weight of papermaking fibers, more preferably in an amount from about 10% to about 15% by weight of papermaking fibers. However, it is important to note that experience to date suggests that an excess of the borate compound may not be desired. For example, when the borate: compound comprises boric acid, it is important to control the amount of boric acid added to the aqueous suspension of papermaking fibers as the desired boron ester complex has been found to break down under acidic conditions below a pH of about 5. Further, experience to date does not suggest that the ester complex binds strongly to the papermaking fibers, as excess washing tends to remove the boron ester complex from the wet web.

It is contemplated that the borate compound may be introduced into the aqueous suspension of papermaking fibers at any time during the manufacturing process before drying. For example, the borate compound may be introduced into the aqueous suspension during pulping or by applying (e.g., spraying) the borate compound onto a formed wet web after deposition of the aqueous suspension of papermaking fibers onto a sheet-forming fabric. However, it is preferred that the borate compound be introduced into the aqueous suspension of papermaking fibers prior to depositing the aqueous suspension onto a sheet-forming fabric (e.g., during pulping) to ensure that the borate compound is completely dispersed throughout the aqueous suspension of papermaking fibers. The borate compound may be introduced into the aqueous suspension of papermaking fibers in any convenient manner. For example, boric acid may be charged to the pulper as a solid or introduced in an aqueous solution. The pulper is conventionally a stirred vessel and provides agitation sufficient to disperse the borate compound throughout the suspension of papermaking fibers within a reasonable residence time.

After the suspension of papermaking fibers is formed, the suspension is deposited onto a sheet-forming fabric to form a wet web. The web forming apparatus can be any conventional apparatus known in the art of papermaking. For example, such web formation apparatus include Fourdrinier, roof formers (e.g., suction breast roll), gap formers (e.g., twin wire formers, crescent formers), or the like.

After the wet web has been formed, the web is partially dewatered before drying. Partial dewatering may be achieved by any means generally known in the art, including vacuum dewatering (e.g., vacuum boxes) and/or mechanical pressing operations.

The partially dewatered web may be dried by any means generally known in the art for making cellulosic base sheets, including Yankee dryers and through-air dryers. Preferably, the wet-laid web is through-dried by passing heated air through the web at a temperature of at least about 190° C. (375° F.). More preferably, the temperature of the heated air passed through the wet web is from about 190° C. (375° F.) to about 210° C. (410° F.), even more preferably from about 200° C. (395° F.) to about 205° C. (400° F.). The process of the present invention including introducing a borate compound into the aqueous suspension of papermaking fibers allows the wet web to be dried at relatively high temperatures while substantially reducing or eliminating the production of malodors upon re-wetting of the base sheet and/or paper products made therefrom.

As described above, the borate compound may be introduced into the aqueous suspension of papermaking fibers either before or after the suspension is deposited onto the sheet-forming fabric. When the borate compound is introduced into the aqueous suspension after the suspension has been deposited onto the sheet-forming fabric, the wet web may be partially dewatered prior to the introduction of the borate compound. For example, after deposition of the aqueous suspension onto a sheet-forming fabric, the borate compound is introduced into the aqueous suspension by applying (e.g., spraying) the borate compound onto the wet web having a consistency of from about 20% to about 80% (e.g., onto a wet web which has a consistency of about 20%, 25%, 30%, 35%, 40%, 50%, 60%, 70% or 80%). In any case, as with introducing the borate compound to the aqueous suspension of papermaking fibers during pulping, it is important to apply the borate compound equally across the wet web to ensure that the borate compound is uniformly dispersed into the aqueous suspension.

Individual cellulosic paper products made from the base sheets in accordance with the present invention may, include, for example, tissues, absorbent towels, napkins, and wipes of one or more plies and varying finish basis weights. For multi-ply products, it is not necessary that all plies of the product be the same, provided that at least one ply is made in accordance with the present invention. Suitable basis weights for these products can be from about 5 to about 70 grams/m$^2$. In accordance with a preferred embodiment, the cellulosic paper products have a finish basis weight ranging from about 25 to about 45 grams/m$^2$, even more preferably from about 30 to about 40 grams/m$^2$.

The process of the present invention has not been found to significantly alter the physical properties of the cellulosic base sheet products produced by the process in any capacity other the substantial reduction in the release of malodor upon re-wetting. For example, through-dried cellulosic base sheets produced by the process of the invention generally contain an amount of stretch of from about 5 to about 40 percent, preferably from about 15 to about 30 percent. Further, products of this invention can have a machine direction tensile strength of about 1000 grams or greater, preferably about 2000 grams or greater, depending on the product form, and a machine direction stretch of about 10 percent or greater, preferably from about 15 to about 25 percent. More specifically, the preferred machine direction tensile strength for products of the invention may be about 1500 grams or greater, preferably about 2500 grams or greater. Tensile strength and stretch are measured according to ASTM D1117-6 and D1682. As used herein, tensile strengths are reported in grams of force per 3 inches (7.62 centimeters) of sample width, but are expressed simply in terms of grams for convenience.

The aqueous absorbent capacity of the products of this invention is at least about 500 weight percent, more preferably about 800 weight percent or greater, and still more preferably about 1000 weight percent or greater. It refers to the capacity of a product to absorb water over a period of time and is related to the total amount of water held by the product at its point of saturation. The specific procedure used to measure the aqueous absorbent capacity is described in Federal Specification No. UU-T-595C and is expressed, in percent, as the weight of water absorbed divided by the weight of the sample product.

The products of this invention can also have an aqueous absorbent rate of about 1 second or less. Aqueous absorbent rate is the time it takes for a drop of water to penetrate the surface of a base sheet in accordance with Federal Specification UU-P-3Ib.

Still further, the oil absorbent capacity of the products of this invention can be about 300 weight percent or greater, preferably about 400 weight percent or greater, and suitably from about 400 to about 550 weight percent. The procedure used to measure oil absorbent capacity is measured in accordance with Federal Specification UUT 595B.

The products of this invention exhibit an oil absorbent rate of about 20 seconds or less, preferably about 10 seconds or less, and more preferably about 5 seconds or less. Oil absorbent rate is measured in accordance with Federal Specification UU-P-31b.

Definitions

As used herein, the term "unsubstituted hydrocarbyl" describes organic compounds or radicals consisting exclusively of the elements carbon and hydrogen. These moieties include alkyl, alkenyl, alkynyl and aryl moieties. These moieties also include alkyl, alkenyl, alkynyl and aryl moieties substituted with other aliphatic or cyclic hydrocarbon groups, such as alkaryl, alkenaryl and alkynaryl. Unless otherwise indicated, these moieties preferably comprise from 1 to about 20 carbon atoms.

As used herein, the term "substituted hydrocarbyl" describes hydrocarbyl moieties which are substituted with at least one atom other than carbon, including moieties in which a carbon chain atom is substituted with a hetero atom such as nitrogen, oxygen, silicon, phosphorus, boron, sulfur or a halogen atom. These substituents include halogen, heterocyclo, alkoxy, alkenoxy, alkynoxy, aryloxy, hydroxy, protected hydroxy, keto, acyl, acyloxy, nitro, amino, amido, cyano, thiol, ketal, acetal, sulfoxide, ester, thioester, ether, thioether, hydroxyalkyl, urea, guanidine, amidine, phosphate, amine oxide and quaternary ammonium salt.

As used herein, the term "alkyl" describes alkyl groups containing from one to about 20 carbon atoms in the principal chain. They may be straight or branched chain or cyclic and include methyl, ethyl, n-propyl, isopropyl, n-butyl, isobutyl, sec-butyl, tert-butyl, hexyl, 2-ethylhexyl and the like.

As used herein, the term "alkenyl" describes alkenyl groups containing from 1 to about 20 carbon atoms in the principal chain. They may be straight or branched chain or cyclic and include ethenyl, propenyl, isopropenyl, butenyl, isobutenyl, hexenyl, and the like.

As used herein, the term "alkynyl" describes alkynyl groups containing from 1 to about 20 carbon atoms in the principal chain. They may be straight or branched chain and include ethynyl, propynyl, butynyl, isobutynyl, hexynyl, and the like.

As used herein, the term "aryl" describes optionally substituted homocyclic aromatic groups, preferably monocyclic or bicyclic groups containing from 6 to 12 carbon atoms in the ring portion, such as phenyl, biphenyl, naphthyl, substituted phenyl, substituted biphenyl, or substituted naphthyl. Phenyl and substituted phenyl are the more preferred aryl.

As used herein, the term "aralkyl" describes a group containing both alkyl and aryl structures such as benzyl.

EXAMPLES

The following examples set forth one approach that may be used to carry out the process of the present invention. Accordingly, these examples should not be interpreted in a limiting sense.

Example 1

This example demonstrates an experiment designed to determine the relative odor intensity of compounds released from through-dried cellulosic base sheets manufactured by a conventional UCTAD process (i.e., without borate compound addition). The experiment employed a CHARM analysis to determine the relative odor intensity of each compound. The CHARM protocol is described generally, for example, by Acree et al. in *Food Chem.,* 184:273–86 (1984), which is hereby incorporated by reference. As described by Acree et al., the CHARM analysis comprises sequentially diluting a series of samples to determine the strongest smelling components of a sample.

The experiment comprised wetting samples of through-dried cellulosic base sheets (ranging from about 6 to about 20 g of pulp) with water. The gases evolved from the wetted base sheets were concentrated onto a sorbent trap (150 mg each of glass beads/Tenax TA/Ambersorb/charcoal commercially available from Envirochem, Inc.) and thermally desorbed into a gas chromatograph (GC) (such as a HP 5890 GC commercially available from Hewlett-Packard, Inc.) and/or a gas chromatograph/mass spectrometer (GC/MS) (such as a HP 5988 commercially available from Hewlett-Packard, Inc.). The gas chromatograph was also fitted with a sniffer port to allow the operator to determine if the eluted compounds had an odor, a procedure described as gas chromatograph olfactometry (GCO). Each eluted compound that produced an odor at the sniffer port was recorded. A voice actuated tape recorder was used to record sensory impressions. The sample was then diluted and analyzed again.

Different sample sizes were analyzed until no odor components could be detected. The largest sample size (16 g) was analyzed three times to ensure that all odorous compounds were detected. Thereafter, only the retention times of compounds determined to be odorous were evaluated in duplicate. Each successive sample was diluted to comprise one-third the amount of material of the previous sample.

Results and Discussion

The GC/MS chromatograms indicated that numerous compounds were evolved from the wetted base sheets. In a typical analysis, each peak of the chromatograms would be assigned to a particular chemical and a literature search would be undertaken to determine which of the chemicals have an odor. Since relatively few compounds have published odor thresholds, it would be difficult to determine whether an individual chemical would be odorous at the concentrations present in the sample. Thus, the ability to determine which peaks are odorous using GCO greatly simplifies the task of identifying the compounds responsible for the odor.

From all the compounds detected, only 17 peaks were found to possess an odor by GCO. CHARM analysis determined that two peaks accounted for more than 70% of the odor intensity, with four peaks comprising 85% of the odor intensity. From the combination of CHARM and GC/MS analysis, it is clear that the odor can be attributed to aldehydes. The most odorous compounds appear to be $C_7$–$C_{10}$ aldehydes which have odor thresholds typically ranging from about 100 parts per trillion (ppt) to about 3 parts per billion (ppb).

Example 2

This example demonstrates the addition of boric acid to an aqueous suspension of papermaking fibers as a treatment for malodor in wetted base sheets. The experiment was conducted as a comparison between adding chemical treatment of ordenone deodorizer, forestall deodorizer, boric acid and alum directly to an aqueous suspension of papermaking fibers before sheet formation. The base sheets were formed by the TAPPI British Standard method and oven dried at 195° C. The dried sheets were then re-wet with water and observed for odor. Results were as follows:

TABLE 1

| Treatment | Amount | Odor |
|---|---|---|
| Boric Acid | 1 gram | Weak |
| Alum | 1 gram | Burnt |
| Ordenone Deodor. | 5 drops | Weak |
| Forestall Deodor. | 5 drops | Weak |

Example 3

This example demonstrates the addition of boric acid to an aqueous suspension of papermaking fibers as a treatment for base sheet malodor. Boric acid (0.657 g) was added to an aqueous suspension of papermaking fibers (500 mL comprising 1% papermaking fiber) during pulping and mixed thoroughly. After the addition of boric acid, the suspension had a pH of about 6. Base sheets were formed from the suspension and oven dried at about 160° C. (320° F.) for about 10 minutes. Upon re-wetting, the dried base sheets did not exhibit an odor.

Example 4

This example demonstrates the addition of boric acid to an aqueous suspension of papermaking fibers as a treatment for base sheet malodor. Boric acid (1.063 g) was added to an aqueous suspension of papermaking fibers (260 mL comprising 1% papermaking fiber) during pulping and mixed thoroughly. After the addition of boric acid, the suspension had a pH of about 6. Base sheets were formed from the suspension and oven dried at about 160° C. (320° F.) for about 10 minutes. Upon re-wetting, the dried base sheets did not exhibit an odor.

Example 5

This example demonstrates odor panel testing results for cellulose base sheets prepared by the process of the present invention. The experiment was conducted with twenty panelists, each of whom examined six products which had been misted with water. The panelists then ranked the products in order from mildest odor to strongest odor. The six products consisted of 100% cellulose base sheets including: (1) an untreated base sheet prepared by a conventional pulping and through-drying process (i.e., without borate compound addition); (2) a base sheet prepared by a conventional process modified by adding boric acid to the pulp before sheet formation; (3) a base sheet prepared by a conventional process modified by adding an ordenone deodorizer; (4) a base sheet prepared by a conventional process modified by adding sodium bicarbonate to the pulp before sheet formation.

The panelist results were analyzed by an ordinal regression model (SAS Procedure PHREG). Ranking the results from mildest to strongest, the probability of having a "milder" odor versus all other results is shown in Table 2 along with the significance groupings. Codes with the same significance group letter were not significantly different from one another at a 95% confidence level.

TABLE 2

Probability Results from Odor Panel Testing

| Product Type | Probability of having "milder" odor | Significance Grouping | |
|---|---|---|---|
| (3) O. Deodorizer | 0.26 | A | |
| (2) Boric Acid | 0.22 | A | B |
| (4) Sodium Bicarbonate | 0.16 | A | B |
| (1) Untreated | 0.14 | A | B |

As can be seen from the odor panel results, treatment of the pulp with boric acid before the base sheet is formed was found to have the second highest probability of producing less odor than any of the other treated products.

Example 6

This example demonstrates odor panel testing results for cellulose base sheets prepared by the process of the present invention. This experiment was conducted with nineteen panelists, each of whom examined six products which had been misted with water and ranked the products in order from mildest odor to strongest odor. The six products consisted of 100% cellulose base sheets including: (1) an untreated base sheet prepared by a conventional pulping and through-drying process; (2) a base sheet prepared by a conventional process modified by adding sodium bicarbonate to the pulp to adjust the pulp pH to about 8 before sheet formation; (3) a base sheet prepared by a conventional process modified by adding boric acid to the pulp before sheet formation; (4) a base sheet prepared by a conventional process modified by adding an ordenone deodorizer; (5) a base sheet prepared by a conventional process modified by adding polyethylene glycol; and (6) a base sheet prepared by a conventional process modified by adding silane to the pulp before sheet formation.

The panelists results were analyzed by an ordinal regression model (SAS Procedure PHREG). Ranking the results from mildest to strongest, the probability of having a "milder" odor versus all other results is shown in Table 3 along with the significance groupings. Codes with the same significance group letter were not significantly different from one another at a 95% confidence level.

TABLE 3

Probability Results from Odor Panel Testing

| Product Type | Probability of having "less" odor | Significance Grouping | | |
|---|---|---|---|---|
| (6) Silane | 0.00 | A | | |
| (1) Untreated | 0.06 | B | | |
| (2) Sodium Bicarbonate | 0.10 | B | C | |
| (4) Ordenone Deodorizer | 0.16 | | C | |
| (3) Boric Acid | 0.22 | | C | D |
| (5) Polyethylene Glycol | 0.46 | | | D |

As can be seen from the odor panel results, treatment of the pulp with boric acid before the base sheet is formed was found to have the second highest probability of producing less odor than any of the other treated products.

In view of the above, it will be seen that the several objects of the invention are achieved. As various changes could be made in the above material and processes without departing from the scope of the invention, it is intended that all matter contained in the above description be interpreted as illustrative and not in a limiting sense.

What is claimed is:

1. A process for manufacturing a cellulosic paper product, the process comprising:

forming an aqueous suspension of papermaking fibers;

introducing boric acid into said aqueous suspension in an amount from about 5 to about 20% by weight of papermaking fibers present in said aqueous suspension;

depositing said aqueous suspension onto a sheet-forming fabric to form a wet web; and through-drying said wet web by passing heated air through said wet web.

2. A process as set forth in claim 1 wherein said boric acid is introduced into said aqueous suspension in an amount from about 10 to about 15% by weight of papermaking fibers present in said aqueous suspension.

3. A process for making a cellulosic paper product, the process comprising:

forming an aqueous suspension of papermaking fibers;

introducing boric acid into said aqueous suspension in an amount ranging from about 5 to about 20% by weight of papermaking fibers present in said aqueous suspension;

depositing said aqueous suspension onto a sheet-forming fabric to form a wet web, said boric acid being introduced into said aqueous suspension prior to depositing said aqueous suspension onto said sheet-forming fabric; and through-drying said wet web by passing heated air through said wet web.

4. A process as set forth in claim 3 wherein said boric acid is introduced into said aqueous suspension in an amount ranging from about 10 to about 15% by weight of papermaking fibers present in said aqueous suspension.

5. A process for manufacturing a cellulosic paper product, the process comprising:

forming an aqueous suspension of papermaking fibers;

introducing boric acid into said aqueous suspension in an amount from about 5 to about 20% by weight of papermaking fibers present in said aqueous suspension;

depositing said aqueous suspension onto a sheet-forming fabric to form a wet web, said boric acid being introduced into said aqueous suspension prior to depositing said aqueous suspension onto said sheet-forming fabric; and dewatering and drying said wet web.

6. A process as set forth in claim 5 wherein said boric acid is introduced into said aqueous suspension in an amount from about 10 to about 15% by weight of papermaking fiber present in said aqueous suspension.

7. A process as set forth in claim 5 wherein said wet web is through-dried by passing heated air through said wet web.

* * * * *